US006209734B1

(12) United States Patent
Wang

(10) Patent No.: US 6,209,734 B1
(45) Date of Patent: Apr. 3, 2001

(54) WALL MOUNTING ORGANIZER

(76) Inventor: Wen-Tsan Wang, P.O. Box 82-144, Taipei (TW)

( * ) Notice: Subject to any disclaimer, the term of this patent is extended or adjusted under 35 U.S.C. 154(b) by 0 days.

(21) Appl. No.: 09/575,798

(22) Filed: May 22, 2000

(51) Int. Cl.[7] ..... A47F 5/00

(52) U.S. Cl. ..... 211/87.01; 211/13.1; 211/10; 211/85.15; 248/205.2; 383/39

(58) Field of Search ..... 211/87.01, 88.01, 211/71.01, 85.15, 85.3, 13.1, 10, DIG. 1; 248/205.2; 383/39

(56) References Cited

U.S. PATENT DOCUMENTS 821,986 * 5/1906 Coburn .
3,717,188 * 2/1973 Green .
4,736,853 * 4/1988 O'Mara ..... 211/13.1 X
4,859,084 * 8/1989 Kaumeyer ..... 383/39
5,503,476 * 4/1996 Hamdan ..... 383/40 X
5,533,534 * 7/1996 Cariello et al. .
5,540,501 * 7/1996 Franco .
5,779,033 * 7/1998 Roegner ..... 383/39 X

* cited by examiner

*Primary Examiner*—Robert W. Gibson, Jr.
(74) *Attorney, Agent, or Firm*—A & J

(57) ABSTRACT

A wall mounting organizer is constructed to include a flexible mounting base having mounting holes for hanging and pockets of different sizes for holding small items, detachable small bags detachably fastened to the mounting base by hook and loop materials, and a dirty clothes collecting bag detachably fastened to turn-locks at the mounting base, the dirty clothes collecting bag having a zipper at a bottom panel thereof that can be opened for enabling collected dirty clothes to fall out of the dirty clothes collecting bag when picking up collected dirty clothes for washing.

2 Claims, 4 Drawing Sheets

WALL MOUNTING ORGANIZER

BACKGROUND OF THE INVENTION

The present invention relates to a wall mounting organizer, and more particularly to such a wall mounting organizer, which comprises pockets of different sizes for holding small items, detachable small bags for holding personal items, and a detachable dirty clothes collecting bag for collecting dirty clothes.

In our daily life, we may use different containers means, such as storage boxes, cabinets, baskets, organizers, and etc. to hold different things. Various wall-mounting organizers are well known and have appeared on the market. These wall mounting organizers are commonly made of cloth or plastic sheet material, having pockets and bags of different sizes at the front side wall of the mounting base thereof for holding documents, newspapers, magazines, hair and body care products, clothes, etc. The pockets and bags are not detachable because they are fixedly fastened to the mounting base by stitches or a heat-sealing apparatus. Further, when picking up collected dirty clothes from the bag at the mounting base, the user must insert the hand into the bag and then take collected dirty clothes out of the bag with the fingers. It is not hygienic to grasp dirty clothes directly with the hand.

SUMMARY OF THE INVENTION

The present invention has been accomplished to provide a wall-mounting organizer, which eliminates the drawbacks of conventional wall mounting organizers. According to one aspect of the present invention, the wall mounting organizer comprises a flexible mounting base for hanging on the wall, a plurality of pockets of different sizes fixedly provided at the mounting base for holding small items, and a plurality of small bags detachably fastened to the mounting base by hook and loop materials for holding personal items. According to another aspect of the present invention, a dirty clothes collecting bag is detachably fastened to turn-locks at the mounting base for collecting dirty clothes. According to still another aspect of the present invention, the dirty clothes collecting bag has a re-closable bottom opening, which when opened, enables collected dirty clothes to fall out of the dirty clothes collecting bag when picking up collected dirty clothes for washing.

DETAILED DESCRIPTION OF THE PREFERRED EMBODIMENT

Figure 1:
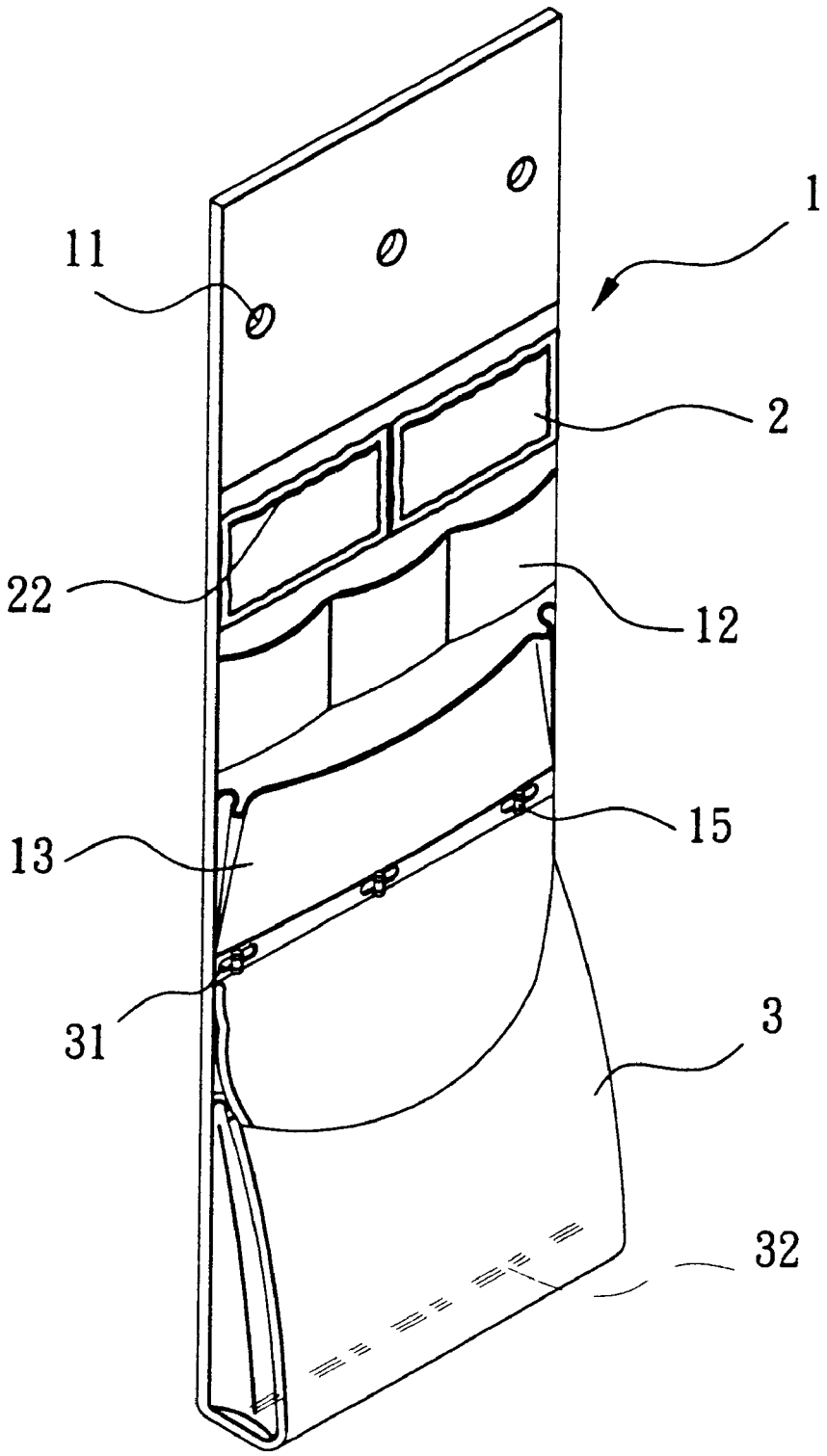
FIG. 1 is an elevational view of a wall-mounting organizer according to the present invention.

Referring to FIGS. from 1 through 3, a wall mounting organizer is generally comprised of a flexible mounting base 1, a plurality of detachable small bags 2, and a dirty clothes collecting bag 3. The mounting base 1 is made of cloth or soft plastic material, having a plurality of hanging holes 11 disposed near the top side thereof for hanging, a plurality of small pockets 12 and big pockets 13 at the front side wall thereof holding items of different sizes, a fixed strip of loop material 14 transversely disposed at the front side wall above the pockets 12 and 13 for holding the detachable small bags 2, and a plurality of turn-locks 15 transversely arranged in a line at the front side wall near the bottom side thereof for securing the dirty clothes collecting bag 3. The detachable small bags 2 are detachably fastened to the front side wall of the mounting base 1, each having a fixed strip of hook material 21 disposed at the back side wall thereof and detachably fastened to the strip of loop material 14 at the mounting base 1. The dirty clothe collecting bag 3 comprises a plurality of eyelets 31 transversely arranged in a line at the top side thereof and respectively fastened to the turn-locks 15 at the mounting base 1, and a zipper 32 provided at the bottom panel thereof.

Figure 4:
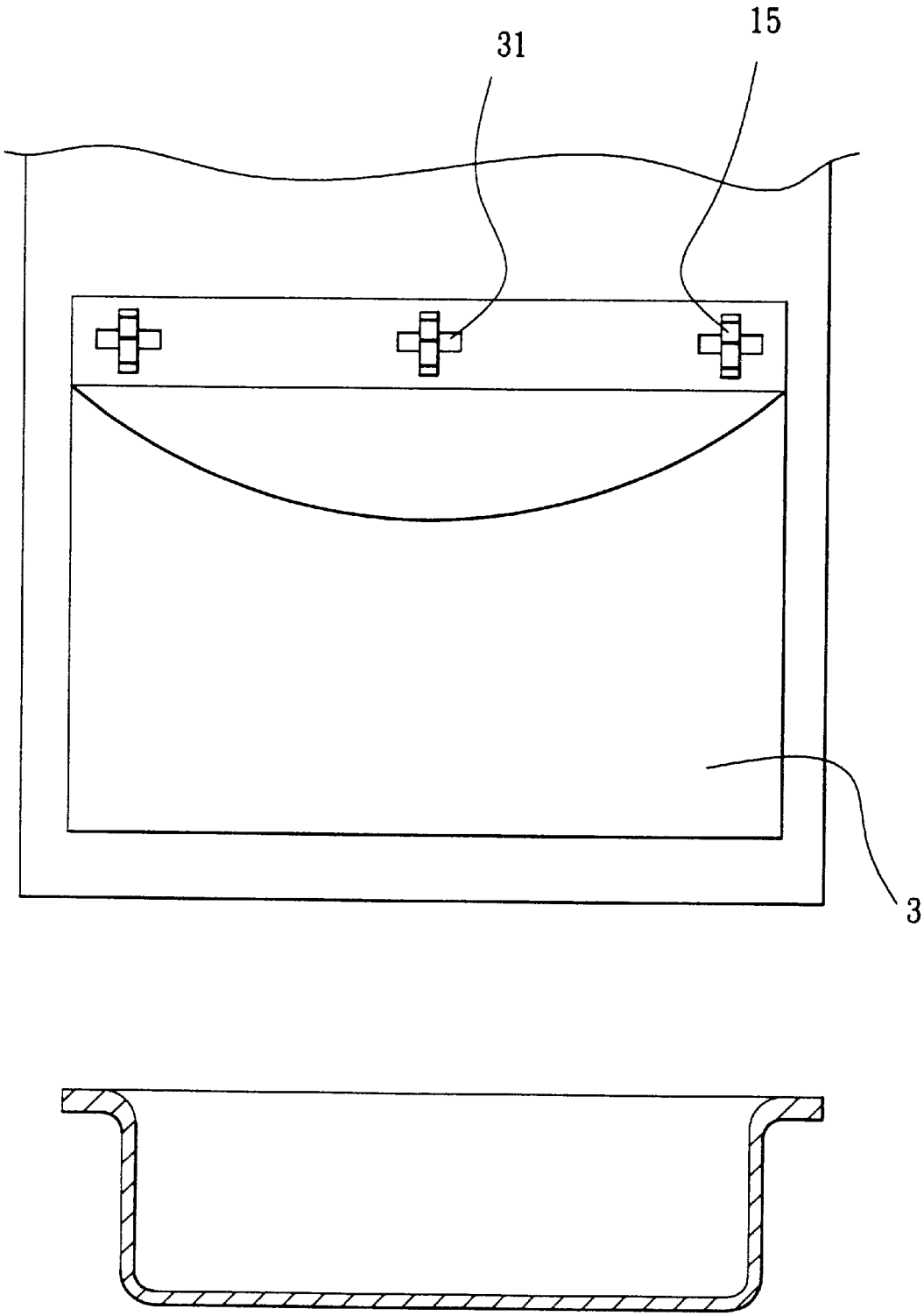
FIG. 4 shows a basket put below the wall mounting organizer to collect collected dirty clothes from the dirty clothes collecting bag according to the present invention.

Referring to FIGS. 1 and 4, when picking up collected dirty clothes from the dirty clothes collecting bag 3, a basket is put below the wall mounting organizer, and then the zipper 32 is opened to let collected dirty clothes fall to the basket.

Figure 2:
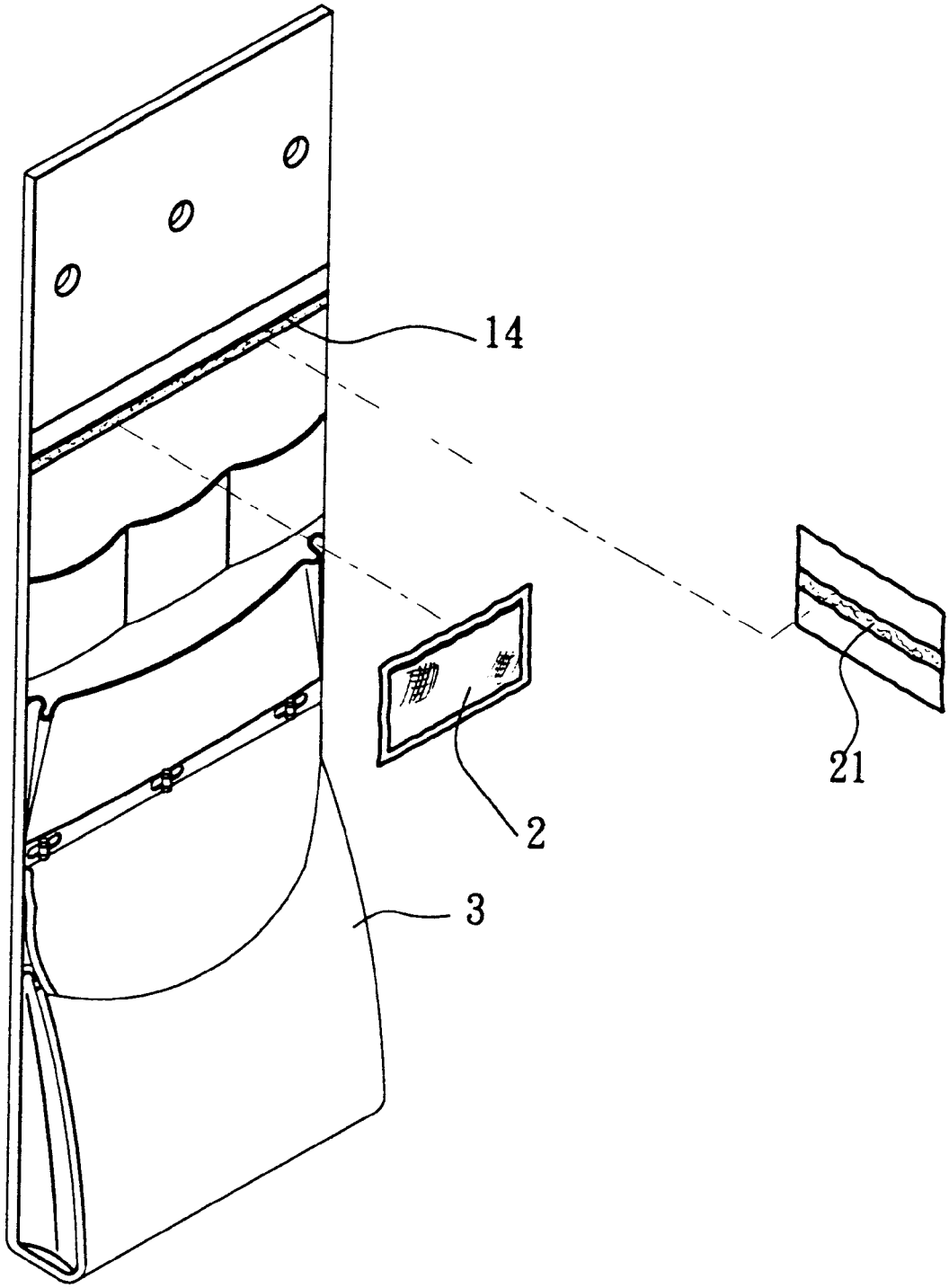
FIG. 2 shows the small bags detached from the mounting base according to the present invention.

Referring to FIGS. 1 and 2 again, the detachable small bags 2 can be detached from the fixed strip of loop material 14 at the mounting base 1 and carried with oneself to keep small personal items when going outdoors.

Figure 3:
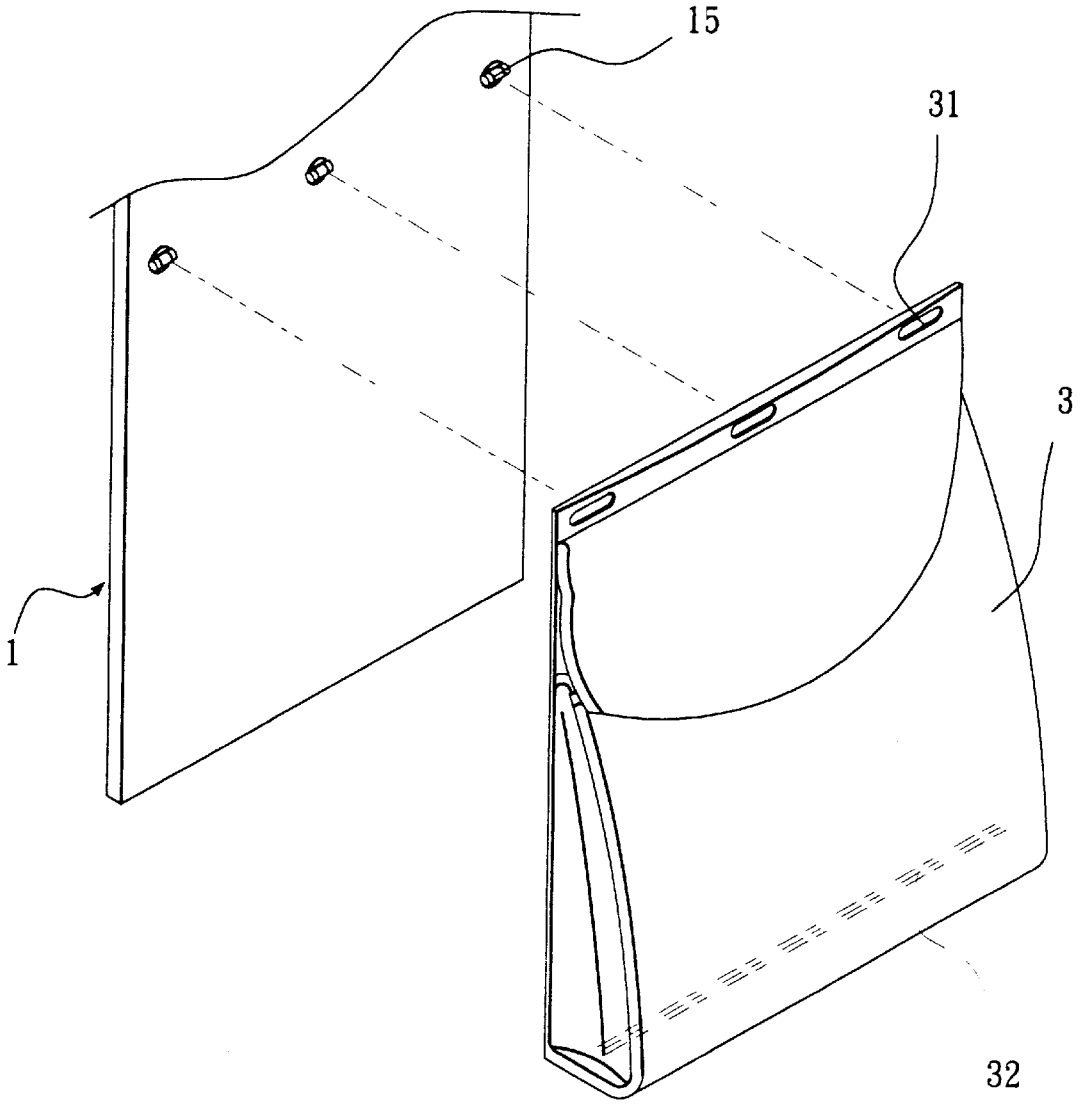
FIG. 3 is an enlarged view of a part of the present invention, showing the dirty clothes collecting bag detached from the mounting base.

Referring to FIGS. 1 and 3 again, after insertion of the turn-locks 15 into the eyelets 31 on the dirty clothes collecting bag 3, the turn-locks 15 are turned through 90° from the unlocking position to the locking position to lock the dirty clothes collecting bag 3 (see FIGS. 1 and 3). On the contrary, when the turn-locks 15 are turned reversely through 90° from the locking position to the unlocking position, the dirty clothes collecting bag 3 is unlocked and can be removed from the mounting base 1 for washing.

While only one embodiment of the present invention has been shown and described, it will be understood that various modifications and changes could be made thereunto without departing from the spirit and scope of the invention disclosed.

What the invention claimed is:

1. A wall mounting organizer comprising:

a flexible mounting base, said flexible mounting base comprising a plurality of hanging holes near the top side thereof, a plurality of turn-locks near the bottom side thereof, and a plurality of small pockets and big pockets at a front side wall thereof;

a plurality of detachable small bags respectively mounted on the front side wall of said mounting base;

detachable fastening means for securing said detachable small bags to said mounting base, said detachable fastening means comprising female fastening means provided at said mounting base, and male fastening means provided at said detachable small bags for fastening to said female fastening means; and a dirty clothes collecting bag for hanging on said mounting base for collecting dirty clothes, said dirty clothes collecting bag comprising a plurality of eyelets disposed at a top side thereof and respectively fastened to the turn-locks at said mounting base, and a zipper at a bottom panel thereof.

2. The wall mounting organizer of claim 1 wherein said detachable fastening means comprises at least one strip of loop material respectively fixedly provided at said mounting base, and a plurality of strip of hook material respectively fixedly provided at said small bags.

* * * * *